US006131829A

United States Patent [19]

Ricco

[11] Patent Number: 6,131,829

[45] **Date of Patent: *Oct. 17, 2000**

[54] ADJUSTABLE METERING VALVE FOR AN INTERNAL COMBUSTION ENGINE FUEL INJECTOR

[75] Inventor: Mario Ricco, Bari, Italy

[73] Assignee: Elasis Sistema Ricerca Fiat nel Mezzogiorno Societa Consortile per Azioni, Italy

[ * ] Notice: This patent is subject to a terminal disclaimer.

[21] Appl. No.: 09/191,018

[22] Filed: Nov. 12, 1998

[30] Foreign Application Priority Data

Nov. 18, 1997 [IT] Italy ..... T097A1007

[51] Int. Cl.[7] ..... B05B 1/30

[52] U.S. Cl. ..... 239/585.1; 239/585.3; 251/129.16; 251/129.18; 251/129.21

[58] Field of Search ..... 239/585.1, 585.2, 239/585.3, 585.4, 585.5, 533.1, 533.2, 533.3, 533.6, 533.8, 533.9, 533.15; 251/129.18, 129.16, 129.21; 123/470, 472; 335/273

[56] References Cited

U.S. PATENT DOCUMENTS 5,381,999 1/1995 Ricco ..... 251/129.16
5,560,549 10/1996 Ricco et al. ..... 239/533.8
5,820,101 10/1998 Ricco ..... 251/129.16
5,901,941 5/1999 Ricco ..... 251/129.16

FOREIGN PATENT DOCUMENTS 0604915 7/1994 European Pat. Off. .

*Primary Examiner*—Andres Kashnikow
*Assistant Examiner*—Lisa Ann Douglas
*Attorney, Agent, or Firm*—Ladas & Parry

[57] ABSTRACT

The metering valve is controlled by the armature of an electromagnet; the travel of the armature towards the electromagnet is arrested by a stop member integral with a flange fitted to a hollow body by a ring nut connecting the skirt of the electromagnet; a spacer washer made of elastically compressible material is provided between the flange and a shoulder of the hollow body; and the tightening torque of the ring nut compresses the washer accordingly to adjust the travel of the armature. According to a variation, a washer of rigid material is provided between the flange and the shoulder, and is small in width to form a projecting annular portion of the flange, which portion of the flange is flexed accordingly by the tightening torque of the ring nut.

8 Claims, 2 Drawing Sheets

ADJUSTABLE METERING VALVE FOR AN INTERNAL COMBUSTION ENGINE FUEL INJECTOR

BACKGROUND OF THE INVENTION

The present invention relates to an adjustable metering valve for an internal combustion engine fuel injector.

A metering valve is normally controlled by the armature of an electromagnet, and is fitted to the injector body; and, as the travel or lift of the armature towards the core of the electromagnet affects supply by the injector, while the gap between the armature and the core affects the response of the valve when the electromagnet is deenergized, both travel and gap must be adjusted accurately.

Various metering valves are known in which the armature is connected to a stem guided by a sleeve having a stop flange; and the travel of the armature is defined by the flange arresting against an edge of the sleeve. In one known metering valve, the sleeve is fitted inside the injector via the interposition of a shim, and the electromagnet is fitted to the injector body by means of a skirt and via the interposition of a second shim. In another known metering valve, the flange of the guide sleeve is fitted between a shoulder of the sleeve and an edge of the electromagnet skirt via the interposition of two sets of shims.

In both cases, the two shims are selected from a number of calibrated shims of modular thicknesses differing by a very small amount, which, as is known, for technical reasons, may not be less than the machining tolerances involved, e.g. five microns. A five-micron tolerance, however, represents a fairly rough adjustment in the travel of the armature, so that it is often impossible to keep supply by the injector within the strict limits required by modern, in particular high-power, internal combustion engines.

One injector has been proposed in which the sleeve comprises a threaded member directly engaging an internal thread on the injector body to adjust the travel of the armature by adjusting the tightening torque of the threaded member. Such an injector, however, involves disassembling part of the injector itself.

SUMMARY OF THE INVENTION

It is an object of the present invention to provide an adjustable metering valve, which, as compared with known shims, provides, in an extremely straightforward manner, for more accurately adjusting travel of the armature.

According to the present invention, there is provided a metering valve for an internal combustion engine fuel injector, wherein the metering valve is fitted to a hollow body of the injector, and is controlled by the armature of an electromagnet; the travel of said armature towards said electromagnet being arrested by a stop member fitted to said hollow body; characterized in that said stop member is so fitted by means of a threaded member, which is screwed to a thread on said hollow body with a calibrated tightening torque, so as to adjust the travel of said armature towards said electromagnet by means of said tightening torque; said thread being outside said hollow body; and said threaded member being operated from outside said hollow body.

BRIEF DESCRIPTION OF THE DRAWINGS

Two preferred non-limiting embodiments of the present invention will be described by way of example with reference to the accompanying drawings, in which.

DETAILED DESCRIPTION OF THE INVENTION

Figure 1:
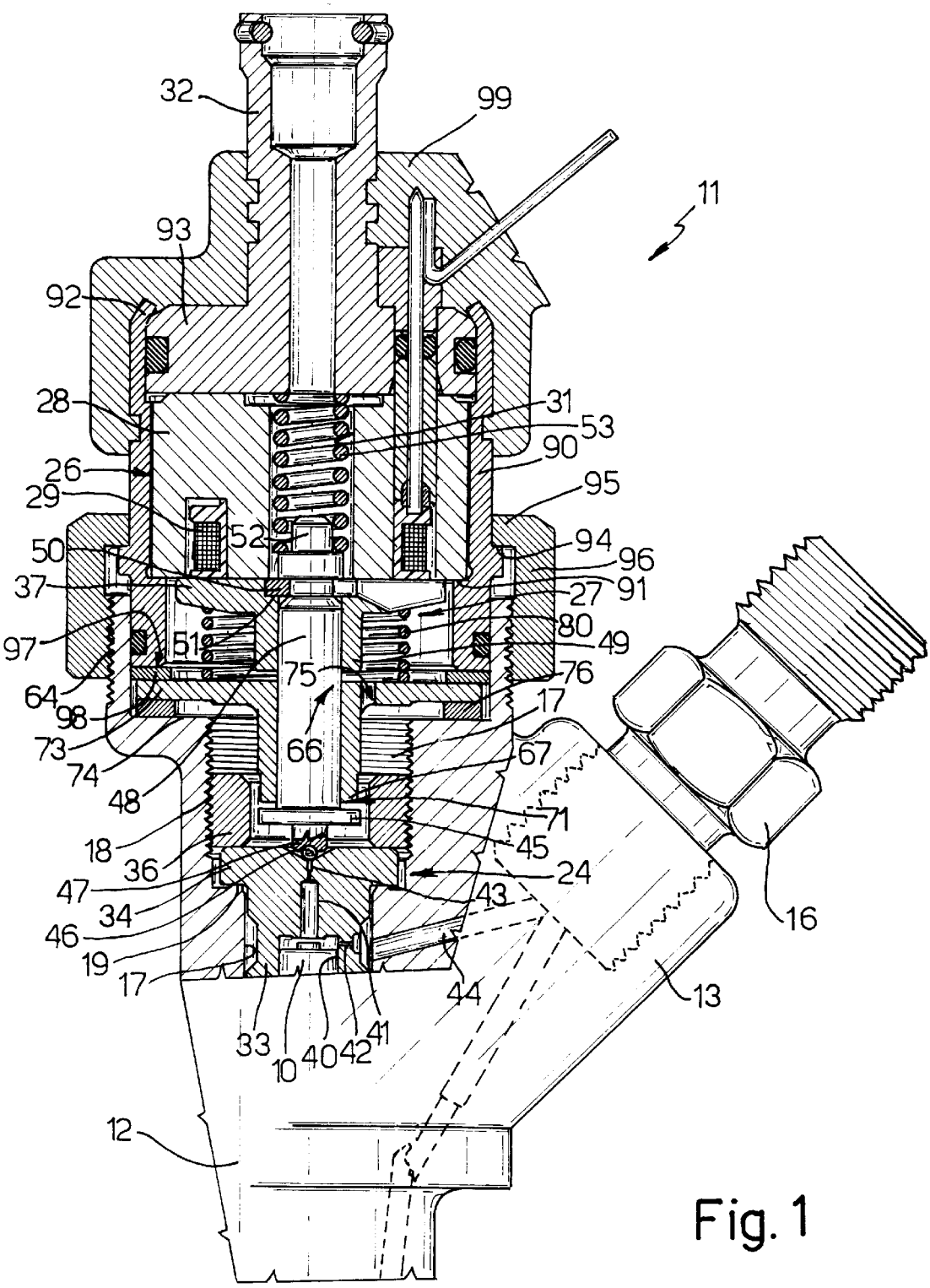
FIG. 1 shows a partial section of a fuel injector incorporating an adjustable metering valve in accordance with the invention.

Numeral 11 in FIG. 1 indicates as a whole a fuel injector, e.g. for an internal combustion engine. Injector 11 comprises a hollow body 12 supporting a nozzle (not shown) terminating at the bottom with one or more injection orifices; a control rod 10, connected to a pin closing the injection orifice, slides inside body 12; and body 12 comprises an appendix 13, in which is inserted an inlet fitting 16 connected to a normal fuel supply pump, and a substantially cylindrical cavity 17 having a thread 18 and a shoulder 19.

Injector 11 also comprises an adjustable metering valve, indicated as a whole by 24, which is housed inside cavity 17 and controlled by an electromagnet 26 controlling an armature 27. Electromagnet 26 comprises an annular magnetic core 28 housing a normal electric coil 29 and having a central hole 31 coaxial with a discharge fitting 32 connected to the fuel tank.

Metering valve 24 comprises a cylindrical valve body 33 having a flange 34, which is normally held resting on shoulder 19 of cavity 17 by an externally threaded ring nut 36 screwed to thread 18 of cavity 17. Armature 27 substantially comprises a disk 37 integral with a sleeve 49; body 33 of valve 24 comprises a control chamber 41 having a discharge conduit 43 communicating with cavity 17; and body 33 also comprises an axial hole 40 adjacent to chamber 41 and in which rod 10 slides, and an inlet conduit 42 communicating with fitting 16 via a conduit 44 in hollow body 12.

The fuel pressure normally holds rod 10 down closing the orifice in the nozzle of injector 11; and discharge conduit 43 of control chamber 41 is normally closed by a ball 46 resting on a conical seat defined by a surface adjacent to conduit 43. Ball 46 is guided by a guide plate 47 acted on by a flange 45 of a cylindrical stem 48 inserted inside sleeve 49; stem 48 comprises a groove in which is inserted a C-shaped ring 50 cooperating with a shoulder 51 of armature 27, so that armature 27 is disconnected from stem 48; and stem 48 projects a given length inside hole 31, and terminates with a smaller-diameter portion 52 for supporting and securing a compression spring 53 housed inside hole 31.

Metering valve 24 comprises a guide member indicated as a whole by 66, and in turn comprising a sleeve 67 in which stem 48 of armature 27 slides. Metering valve 24 also comprises a stop member for arresting armature 27, said stop member being defined by the bottom edge 71 of sleeve 67, against which a shoulder defined by flange 45 of stem 48 is arrested. Guide member 66 also comprises a flange 73 having holes 75 connecting discharge conduit 43 to discharge fitting 32; and a spring 80, over which spring 53 prevails, is provided between disk 37 of armature 27 and flange 73.

Flange 73 rests on another shoulder 74 of hollow body 12 via the interposition of a calibrated spacer washer or shim 76 selectable from a class of modular shims. As is known, for technical reasons, the shims in the spacer washer 76 class may differ by no less than five microns, and therefore provide for preadjusting the travel of armature 27 to approximately five-micron precision.

Core 28 of electromagnet 26 is housed inside a skirt indicated as a whole by 90, and which is made of nonmagnetic material, has an inner shoulder 91, and is fitted to fitting 32 by crimping an edge 92 onto a disk 93 integral with fitting 32, so as to lock core 28 between shoulder 91 and disk 93.

Skirt 90 also comprises an outer shoulder 94 engaged by an inner projection 95 of a threaded member defined by a ring nut 96, which is operated from outside hollow body 12 and screws onto an outer thread 64 of hollow body 12. A shim or spacer 98 is provided between a bottom edge 97 of skirt 90 and flange 73 of guide member 66, and provides for defining the gap between disk 37 and core 28.

Figure 2:
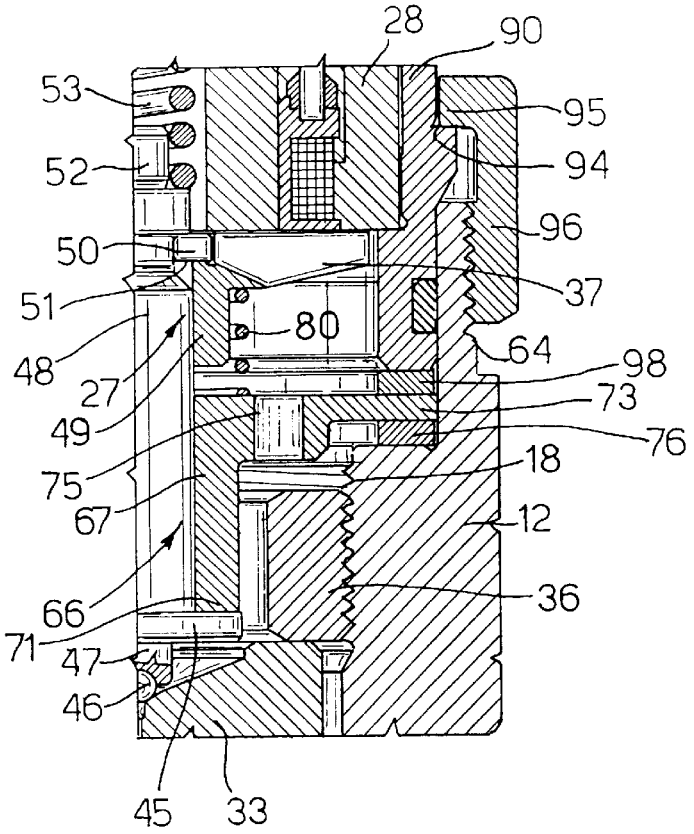
FIG. 2 shows a larger-scale detail of FIG. 1.

In FIGS. 1 and 2 the spacer washer 76 is aligned axially with edge 97 of skirt 90 and with spacer 98, and is made of elastic material, e.g. metal-treated rigid rubber, or light metal such as aluminium, or plastic material such as Teflon (registered trademark).

By virtue of the tightening torque of ring nut 96, flange 73 compresses spacer washer 76 elastically to produce a downward displacement of bottom edge 71 of sleeve 67, which displacement reduces the travel of the armature and, within certain limits, is substantially proportional to the tightening torque.

The surface and thickness of spacer washer 76 and the diameter of ring nut 96 may be so sized as to obtain a given displacement of edge 71, e.g. of one micron, alongside a given variation in the tightening torque, so that adjusting the tightening torque of ring nut 96 enables a fine adjustment of the travel of armature 27 to roughly one-micron precision. Advantageously, said thickness and diameter may be so sized as to obtain a one-micron displacement alongside a one newton/m variation in the tightening torque.

Figure 3:
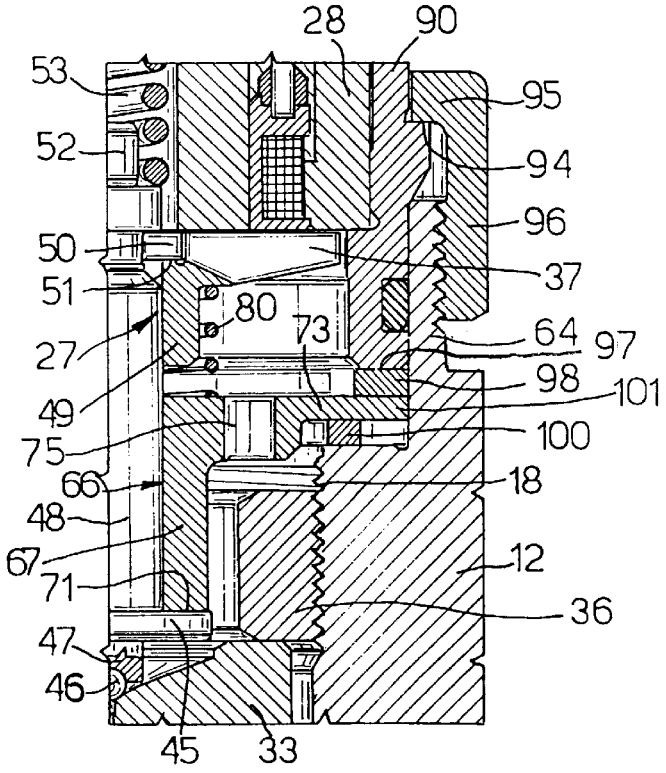
FIG. 3 shows the FIG. 2 detail according to a variation of the invention.

In the FIG. 3 embodiment, between flange 73 and shoulder 74 there is provided a spacer washer 100 made of rigid metal, and the outside diameter of which is less than or equal to the inside diameter of spacer 98 and the inside diameter of edge 97 of skirt 90, so that edge 97 acts on a projecting annular portion 101 of flange 73.

By virtue of the tightening torque of ring nut 96 on thread 64, portion 101 of flange 73 flexes elastically so as to produce a given upward displacement of bottom edge 71 of the sleeve and so increase the travel of armature 27; which travel, in this case, is within certain limits inversely proportional to the variation in torque.

The width and thickness of portion 101 of flange 73 may be so sized as to obtain a given displacement, e.g. of one micron, of edge 71 alongside a given variation of one newton/m in the tightening torque, so that, in this case also, adjusting the tightening torque of ring nut 96 on thread 64 provides for obtaining a fine adjustment of the travel of armature 27.

The advantages, as compared with known metering valves, of the adjustable metering valve according to the invention will be clear from the foregoing description. In particular, a fine adjustment is achieved to a much greater accuracy than that of known technology. Moreover, said adjustment is achieved by simply adjusting the tightening torque of ring nut 96, which is accessible from outside the injector. And finally, said adjustment may even be made when repairing or servicing the injector.

Clearly, changes may be made to the injector as described and illustrated herein without, however, departing from the scope of the accompanying claims. For example, flange 73 in FIG. 2 may be made of elastically compressible material; and the tightening torque may be applied by means of an automatic device having a supply measuring station and a station for correcting the tightening torque according to the supply measurement.

What is claimed is:

1. An adjustable metering valve for an internal combustion engine fuel injector, wherein the metering valve is fitted to a hollow body of the injector, and is controlled by an armature of an electromagnet; said metering valve comprising a stop member fitted to said hollow body to arrest travel of said armature towards said electromagnet, said stop member being fitted by means of a threaded member, which is screwed on a thread on said hollow body with a calibrated tightening torque, so as to adjust the travel of said armature towards said electromagnet by means of said tightening torque; said thread being outside said hollow body; and said threaded member being operated from outside said hollow body.

2. A metering valve as claimed in claim 1, wherein said threaded member acts on said stop member by means of a fastening member for fastening said electromagnet to said hollow body.

3. A metering valve as claimed in claim 2, wherein a valve body of the metering valve is fitted to said hollow body by means of a ring nut said stop member being carried by a guide member for guiding said armature; said guide member comprising a flange acting against a shoulder of said hollow body; and said threaded member being defined by a further ring nut acting on said fastening member.

4. A metering valve as claimed in claim 3, wherein said electromagnet comprises an annular core; wherein said fastening member being defined by a skirt of said electromagnet, said skirt having a shoulder supporting said core.

5. A metering valve as claimed in claim 4, wherein said armature comprises a disk cooperating magnetically with said core; said disk being connected to a stem sliding inside a sleeve of said guide member; and said stop member being defined by an edge of said sleeve, and arresting a shoulder of said stem.

6. A metering valve as claimed in claim 3, wherein said flange is forced against said shoulder of said hollow body via the interposition of a spacer washer of a thickness selectable from a number of modular thicknesses, to effect a preadjustment of said travel.

7. A metering valve as claimed in claim 6, wherein said spacer washer is made of relatively elastic material; said tightening torque elastically compressing said spacer washer.

8. A metering valve as claimed in claim 6, wherein said spacer washer is made of rigid material, and has an outside diameter smaller than the inside diameter of said skirt; said skirt acting on a projecting annular portion of said flange; and said tightening torque elastically flexing said annular portion.

* * * * *